US005092921A

United States Patent [19]

Kobayashi et al.

[11] Patent Number: 5,092,921

[45] Date of Patent: Mar. 3, 1992

[54] METHOD FOR PRODUCING HIGH-PURITY METALLIC CHROMIUM

[75] Inventors: Kenichi Kobayashi, Nishiokitama; Tatsuhiko Fujinuma, Tokyo; Takashi Sasai, Nishiokita, all of Japan

[73] Assignee: Japan Metals & Chemicals Co., Ltd., Tokyo, Japan

[21] Appl. No.: 603,222

[22] Filed: Oct. 25, 1990

[30] Foreign Application Priority Data

Nov. 1, 1989 [JP] Japan ..... 1-283104

[51] Int. Cl.[5] ..... C22B 34/32

[52] U.S. Cl. ..... 75/623; 75/959

[58] Field of Search ..... 75/623, 959

[56] References Cited

U.S. PATENT DOCUMENTS 4,331,475 5/1982 Perfect ..... 75/959

4,504,310 3/1985 Boulier ..... 75/959

FOREIGN PATENT DOCUMENTS 130728 6/1988 Japan ..... 75/623

199832 8/1988 Japan ..... 75/623

*Primary Examiner*—Melvyn J. Andrews

*Attorney, Agent, or Firm*—Oliff & Berridge

[57] ABSTRACT

High-purity metallic chromium is produced by a method of initially preparing a mixture of chromium oxide, aluminum, carbon and an easily sulfidable metallic powder, and subsequently providing a thermite-reaction with the mixture to produce thermite-crude metallic chromium and a solid solution of carbon and easily sulfidable metal. Residual impurities in the thermite-crude metallic chromium are subsequently removed by heat treating the crude metallic chromium. This method produces high-purity metallic chromium advantageous for preparing corrosion and heat resistant chromium-containing alloys.

6 Claims, No Drawings

METHOD FOR PRODUCING HIGH-PURITY METALLIC CHROMIUM

BACKGROUND OF THE INVENTION

The present invention relates to a method of producing high-purity metallic chromium, and more particularly, relates to a method of preparing said mixed material of chromium oxide and aluminum by adding carbon and an easily sulfidable metallic powder thereto in advance, producing thermite-crude metallic chromium by providing thermite reaction with said mixed material so as to make a solid solution of carbon and easily sulfidable metal, and, removing residual impurities such as oxygen and sulfur in said crude metallic chromium by heat treating said crude metallic chromium in a vacuum, and a method of producing high-purity metallic chromium is proposed which is advantageous in the field of electronics and as a material for corrosion and heat resistant chromium-containing alloys.

Recently metallic chromium is widely used as a material for semi-conductors, electronic parts, dry plating, etc., and in these fields metallic chromium which is low in gas components such as oxygen and nitrogen, as well as metallic chromium containing low percentages of sulfur are desired.

In the prior art of producing metallic chromium, a method using a mixed raw material of chromium oxide and aluminum is well known wherein the thermite reaction is utilized, which take place because of the reaction heat produced when chromium oxide is reduced by aluminum. Because this technology, so-called "Thermite Method", can raise the purity of the obtained metallic chromium by selecting raw materials whose impurities contents are low, and controlling the reaction speed, and because it can obtain more high-purity metallic chromium of chemically high-quality than electrolyting a $Cr_2(SO_4)_3$-solution (so-called "Electrolytic Method", it is the most suitable method for preparing materials used in the field of electronics.

The metallic chromium obtained by the thermite method is, however, inevitably contaminated with oxygen in the form of $Al_2O_3$, $Cr_2O_3$, etc., as well as with nitrogen in the form of $Cr_3N$, etc., and it is also inevitably contaminated with sulfur in spite of carefully selected raw materials such as chromium oxide, etc. used for thermite reaction. And, therefore, gas components such as oxygen, nitrogen and sulfur in the thermite-metallic chromium are generated after completion of thermite reaction. These gas components are not small and are harmful impairing the performance of electronic materials and parts. It is therefore advantageous that these components are present as little as possible.

Conventionally, as a method of reducing these impurities gas components to be as little as possible, such a method as that disclosed in Japanese Patent Laid-Open No. 59-56540 is well known. This technology is a method which comprises adding carbon to the metallic chromium after thermite reaction obtained by thermite method, heating it in the vacuum furnace, thereby reducing oxides present in the metallic chromium and concurrently pyrolizing nitrides and sulfides in order to remove oxygen, nitrogen and sulfur in the thermite-metallic chromium.

And the technology disclosed in Japanese Patent Laid-Open No. 63-282217 is a proposal relating to a method wherein an easily sulfidable metallic powder is added to the thermite-metallic chromium powder, mixed therewith, and heated in vacuum in order to remove sulfur.

The method disclosed in said Japanese Patent Laid-open No. 59-56540 is a technology wherein a reducing agent is added to thermite-metallic chromium and heated together at the time of heat treatment in order to remove oxygen present in the form of oxides in the thermite-metallic chromium by reduction. In the detailed method the thermite-metallic chromium is ground first and then carbon powder is added thereto in order to bring them into contact with each other sufficiently, and, if necessary, an agglomerating agent is added and mixed. The mixture is then molded and the obtained molding is heated in vacuum. In this conventional method, however, it is difficult to mix metallic chromium powder and carbon perfectly homogeneously with each other. After heating, therefore, there were portions where oxygen had been insufficiently removed, and carbon remained sometimes unreacted in metallic chromium products.

In addition thereto, there were disadvantages that contaminants from the grinder, etc. at the time of grinding could lead to contamination, and that impurities heavy metals such as Fe, etc. were inevitably contained. Besides, the fact was that no contaminations from an agglomerating agent or a molding machine could be avoided when using an agglomeration agent.

There was also a disadvantage that sulfur could be removed only insufficiently because sulfur was removed by pyrolysis according to this conventional method.

Moreover, this conventional method was also economically disadvantageous because of the grinding and molding processes thereof, and had to be improved as a matter of course when also taking into consideration that each process had to be performed extremely carefully so that no contamination with impurities might occur.

As a technology which can eliminate the disadvantages of said conventional technology that no sulfur is removable, the method of said Japanese Patent Laid-Open No. 63-282217 was proposed. Similarly to the method disclosed in said Japanese Patent Laid-Open No. 59-56540, this conventional method also comprises adding easily sulfidable metallic powder to ground thermite-metallic chromium and mixing them afterwards, and subsequently treating the mixture with heat, however, this method has the same problems in that thermite-metallic chromium powder can not be mixed with said easily sulfidable metallic powder homogeneously, that sulfur is removed only insufficiently, and that contamination with impurities occurs at the grinding.

It is therefore an object of the present invention to provide a technology of producing high-purity metallic chromium by thermite method which can eliminate the problems of the conventional method effectively.

SUMMARY OF THE INVENTION

The method for producing high-purity metallic chromium from a mixed material of chromium oxide and aluminium, comprises the steps of;

preparing a mixed material of chromium oxide and aluminium by adding carbon and an easily sulfidable metallic powder thereto in advance, producing thermite-crude metallic chromium by providing thermite reaction with a mixed material so as to make a solid solution of carbon and easily sulfidable metal, removing residual impurities such as oxygen and sulfur in the crude metallic chromium by heat treating the crude metallic chromium in a vacuum or an inert gas atmosphere in a heating furnace.

At least one metallic powder selected from the group comprising Ni, Cu, Sn and Hg is used as said easily sulfidable metallic powder.

For reduction of the oxygen remaining in the thermite-crude metallic chromium, it is desirable to add carbon in such as amount that the mole ratio to the oxygen remaining in the crude metallic chromium is in a range of 0.8~1.2, and for removal of sulfur, it is desirable to add easily sulfidable metallic powder in such an amount that the mole ratio to the sulfur remaining in the crude metallic chromium is in a range of 0.8~1.2.

When molding a solid solution of thermite-crude metallic chromium by heating in a vacuum, the metallic chromium may be ground previously.

Metallic chromium may be also briquetted in order to prevent sintering or to permit an easier handling.

DESCRIPTION OF THE PREFERRED EMBODIMENTS

In the following, the present invention is described in detail.

In the technology of producing metallic chromium by thermite method wherein metallic chromium is reduced with aluminum, the amount of oxygen remaining in the produced metallic chromium depends on the mixing ratio of chromium oxide and aluminum. It is generally well known that thus obtained thermite-crude metallic chromium contains considerable oxygen. Each of above prior arts is a process to remove the gas substances such as oxygen, nitrogen and sulfur contained in thermite-crude metallic chromium. However, they do not add any carbon and an easily sulfidable metallic powder in the stage of preparing material mixture, but add these materials only after the thermite reaction, so that they could not be mixed with heat treated metallic chromium homogeneously, thus resulting in the problem wherein high-purity products cannot be obtained because segregation of starting material.

The present invention provides a method where by means of adding and mixing in a certain amount of aluminium, for reducing chromium oxide and a pyrogen like potassium chlorate acid, as well as carbon and an easily sulfidable metal into a prepared mixed material for thermite reaction in advance, such additives make a complete solid solution homogeneously in advance in thermite-crude metallic chromium.

It is the first feature of the present invention to provide thermite reaction after initially combining carbon with an easily sulfidable metal.

The carbon needed to reduce the oxygen remaining in the thermite-crude metallic chromium to carbon monoxide is added in such an amount that its mol ratio to the amount of said remaining oxygen is in the range of 0.8~1.2.

On the other hand, the easily sulfidable metal needed to remove the sulfur remaining in the thermite-crude metallic chromium as sulfides should be added in such an amount that its mol ratio to the amount of the sulfur contained in the thermite-crude metallic chromium is within the range of 0.8~1.2.

By adding such appropriate amounts of carbon and easily sulfidable metal to the mixing raw materials in advance, the carbon and the easily sulfidable metal can be solid-solved homogeneously without being vaporized in the thermite-crude metallic chromium after completion of thermite reaction in spite of a high reaction temperature of about 2,000° C.

Preferably, graphite powder or carbon powder is added, or chromium carbide is used as said carbon, and at least one metal powder selected from the group comprising Ni, Cu, Sn and Hg is preferably used for the easily sulfidable metal.

The reason why the mol ratio of carbon to oxygen is 0.8~1.2 is that this amount of carbon is suitable for removing oxygen as carbon monoxide with the subsequent heat treatments, and in particular, more oxygen remains in case of less than 0.8, and more carbon remains in case of more than 1.2.

The reason why the mol ratio of easily sulfidable metal to sulfur is 0.8~1.2 is that more sulfur remains in case of less than 0.8, and that unreacted metal sulfide remains in case of more than 1.2.

In the present invention, the thermite-crude metallic chromium obtained by said processes in which carbon and easily sulfidable metal are solid-solved, is charged into the vacuum heating furnace and treated with heat in vacuum or an inert gas atmosphere, if necessary, after coarse crushing or grinding in order to obtain suitable sizes for products.

This heat treatment under vacuum is performed preferably in a vacuum of about 0.1~2 torr or in an inert gas at a temperature of 1,200° C. and above for several hours, and more preferably in a vacuum of about 0.1~0.3 torr at a temperature of 1,250° C. and above at least for five hours.

The metallic chromium obtained by this heat treatment has an oxygen content of not more than 300 ppm, a carbon content of not more than 100 ppm and a sulfur content of not more than 20 ppm, and its purity is improved as compared with that in case of the coventional methods wherein carbon or easily sulfidable metal is added to the thermite-metallic chromium after thermite reaction. Moreover, in a method of adding carbon or easily sulfidable metal after thermite reaction as in the conventional technologies, the obtained thermite-metallic chromium is required to be ground and subsequently to be molded again, whereas the present invention requires no such treatments and leads to a simplified production process, and it also has an advantage of reducing scattered impurities contents.

The ground thermite-crude metallic chromium may be agglomerated after molding.

EXAMPLE 1

(1) A mixed raw material comprising 100 kg of chromium oxide, 40 kg of needle aluminum, 14 kg of potassium chlorate, 120 g of graphite powder and 50 g of tin powder was charged in a reactor with an inner diameter of 0.5 m lined with magnesia clinker, was ignited using an ignition agent, and was reacted by thermite reaction, thereby producing 57 kg of thermite-crude metallic chromium. 10 kg of the obtained thermite-crude metallic chromium was ground to a size of about 10~30 mm and charged into a vacuum heating furnace.

This vacuum heating furnace was exhausted to 0.05 torr, heated to 1,300° C., and maintained at these conditions for six hours. Subsequently, the furnace was cooled down to a room temperature, and 9.9 kg of product metallic chromium was obtained.

(2) For the purpose of comparison, a mixed raw material without graphite powder and tin powder was prepared and was reacted by thermite reaction. And 10 kg of the thus obtained thermite-crude metallic chromium was finely ground to 246 μm and below (Comparative Example 1), and another 10 kg of said metallic chromium was also ground to a size of 10~30 mm (Comparative Example 2).

20 kg of carbon powder and 10 kg of tin powder were added to these thermite-crude metallic chromiums and mixed with each other, and the mixtures of said metallic chromiums with carbon and tin powders were heat-treated in a vacuum furnace under the same conditions as those described above.

(3) In Table 1, analysis values are shown for thermite-crude metallic chromium and product metallic chromium obtained according to the present invention, as well as for the comparative examples. Samples were taken from each 10 kg of the obtained product metallic chromium and the metallic of Comparative Example 2 at any four points thereof, and were analyzed. The results are shown in Table 2.

Table 1 shows that the present invention has lower contents of gasified components such as oxygen, nitrogen and sulfur as compared with the comparative examples, and Table 2 shows the product metallic chromiums according to the comparative examples have scattered impurities-element contents at different sampling points, whereas the product metallic chromium according to the present invention has uniform impurities-element contents.

TABLE 1

| | (in: ppm) O | N | S | C |
|---|---|---|---|---|
| Example | | | | |
| Crude metallic chromium | 2,800 | 180 | 245 | 1,890 |
| Product metallic chromium | 280 | <10 | 13 | 28 |
| Comparative examples | | | | |
| 1. (−250 μm) | 320 | <10 | 35 | 54 |
| 2. (10~30 mm) | 620 | 45 | 115 | 130 |

TABLE 2

| | | (in: ppm) O | N | S | C |
|---|---|---|---|---|---|
| Product metallic chromium of Example 1 | | | | | |
| Samples | (1) | 310 | <10 | 15 | 32 |
| | (2) | 285 | <10 | 9 | 25 |
| | (3) | 260 | <10 | 7 | 32 |
| | (4) | 270 | <10 | 12 | 28 |
| Comparative example 2 | | | | | |
| Samples | (1) | 1,060 | 53 | 120 | 250 |
| | (2) | 450 | 36 | 45 | 50 |
| | (3) | 800 | 48 | 86 | 35 |
| | (4) | 550 | 60 | 145 | 150 |

EXAMPLE 2

A mixed raw material comprising 100 kg of chromium oxide, 40 kg of needle aluminum, 14 kg of potassium chlorate, 0.5 kg of chromium carbide powder and 25 g of Ni powder was charged in a reactor with an inner diameter of 0.5 m lined with magnesia clinker, and was thermite-reacted using an ignition agent, thereby producing thermite-crude metallic chromium.

The obtained thermite-crude metallic chromium was ground to 246 μm and below, and subsequently, it was put into an alumina container and charged into a vacuum heating furnace. This vacuum heating furnace was exhausted to 1 torr and below, heated to 1,300° C., and maintained at these conditions for five hours. Subsequently, the furnace was cooled down to a room temperature, and high-purity metallic chromium powder of 246 μm and below suitable for powder materials was produced.

In Table 3, the component compositions of the obtained thermite-crude metallic chromium and the product metallic chromium powder are shown.

TABLE 3

| Example 2 | (in: ppm) O | N | S | C |
|---|---|---|---|---|
| Crude metallic chromium | 2,850 | 200 | 250 | 1,920 |
| Product metallic chromium | 255 | <10 | 16 | 30 |

EFFECTS

As described above, the product metallic chromium produced by applying the two processes of thermite treatment and heating deoxidation treatment is a high-purity metallic chromium characterized by its lower impurities contents and less scattered gasified component contents such as oxygen, sulfur and nitrogen as compared with those obtained by thermite method according to the conventional technologies. Moreover, according to the present invention, the metallic chromium of this superior quality can be produced with a low cost.

What is claimed is:

1. A method for producing high-purity metallic chromium, which comprises the steps of:

initially preparing a mixed material by combining chromium oxide, aluminum, carbon and an easily sulfidable metallic powder, wherein said chromium oxide contains impurities;

subjecting said mixed material to a thermite reaction to produce a thermite-crude metallic chromium comprising said impurities and a solid solution of carbon and fine particles of said easily sulfidable metal; and removing said impurities remaining in said crude metallic chromium by heat treating said crude metallic chromium in a vacuum or an inert gas atmosphere in a heating furnace.

2. The method as claimed in claim 1, wherein at least one metallic powder selected from the group consisting of Ni, Cu, and Sn and Hg is used as said easily sulfidable metallic powder.

3. The method as claimed in claim 1, wherein said carbon added to said mixed material is combined with the mixed material in such an amount that the mol ratio of carbon to oxygen remaining in said crude metallic chromium is in a range of 0.8–1.2 and said easily sulfidable metallic powder is combined with said mixed material in such an amount that the mol ratio of carbon to sulfur remaining in said crude metallic chromium is in a range of 0.8–1.2.

4. The method as claimed in claim 1, further comprising grinding said thermite-crude metallic chromium before heating said thermite-crude metallic chromium, wherein said heating takes place in a vacuum heating furnace.

5. The method of producing metallic chromium as claimed in claim 1, further comprising the steps of grinding said thermite-crude metallic chromium, adding an agglomerating agent to said thermite-crude metallic chromium and agglomerating said thermite-crude metallic chromium, and subsequently heating said thermite-crude metallic chromium, wherein said heating takes place in a vacuum furnace.

6. The method of claim 1, wherein said residual impurities comprise oxygen and sulfur.

* * * * *